United States Patent [19]

Ford

[11] Patent Number: 4,589,966

[45] Date of Patent: May 20, 1986

[54] MEMBRANE CELL JUMPER SWITCH

[75] Inventor: James M. Ford, Cleveland, Tenn.

[73] Assignee: Olin Corporation, Cheshire, Conn.

[21] Appl. No.: 783,709

[22] Filed: Oct. 3, 1985

[51] Int. Cl.[4] ..... C25B 9/04; H01H 33/00

[52] U.S. Cl. ..... 204/228; 204/253; 204/267

[58] Field of Search ..... 204/1 R, 98, 128, 228, 204/253, 267; 200/144 B

[56] References Cited

U.S. PATENT DOCUMENTS

| | | | |
|---|---|---|---|
| 2,834,728 | 5/1958 | Gallone | 204/228 |
| 3,573,189 | 5/1971 | Westerlund | 204/228 |
| 3,930,978 | 1/1976 | Strewe et al. | 204/228 |
| 4,078,984 | 3/1978 | Strewe et al. | 204/228 |
| 4,169,775 | 10/1979 | Kuo | 204/98 |
| 4,197,169 | 4/1980 | Zahn et al. | 204/1 R |
| 4,227,987 | 10/1980 | Kircher et al. | 204/228 |
| 4,251,334 | 2/1981 | Kircher | 204/228 |
| 4,277,317 | 7/1981 | Grimes et al. | 204/1 R |
| 4,279,732 | 7/1981 | Bellows et al. | 204/269 |
| 4,312,735 | 1/1982 | Grimes et al. | 204/228 |
| 4,324,634 | 4/1982 | Kircher et al. | 204/228 |
| 4,358,353 | 11/1982 | Bommaraju et al. | 204/98 |
| 4,370,530 | 1/1983 | Wayland | 200/144 |
| 4,371,433 | 2/1983 | Balko et al. | 204/228 |
| 4,377,445 | 3/1983 | Grimes | 204/1 R |
| 4,390,763 | 6/1983 | Hruda | 200/144 B |
| 4,421,614 | 12/1983 | Yamaguchi et al. | 204/98 |
| 4,537,662 | 8/1985 | Hruda | 204/128 |

FOREIGN PATENT DOCUMENTS

| | | |
|---|---|---|
| 57-169095 | 10/1982 | Japan . |
| 59-15362 | 4/1984 | Japan . |

OTHER PUBLICATIONS

Recent Advances in Vacuum Switches, by P. Wayland, R. M. Hruda, Modern Chlor-Alkali Technology, Chapter 20, pp. 249-256.

*Primary Examiner*—John F. Niebling
*Assistant Examiner*—Terryence Chapman
*Attorney, Agent, or Firm*—Ralph D'Alessandro; Thomas P. O'Day

[57] ABSTRACT

An electrolytic cell jumper switch system is disclosed which eliminates all damaging reverse currents without utilizing any additional rectifiers, power supply or auxiliary power or current sources by loading the electrical current flow through resistor modules around the cell to be disconnected, bypassing the current flow around the bus bar connection between the adjacent cells and the cell to be disconnected by closing a connecting switch and finally reopening the connecting switch to transfer the total current load in the switch back to the resistor modules.

14 Claims, 2 Drawing Figures

MEMBRANE CELL JUMPER SWITCH

BACKGROUND OF THE INVENTION

The present invention relates generally to electrolytic cells. More specifically, it relates to the use of a jumper switch system which permits electrical current to bypass at least one of a plurality of electrolytic cells connected in series to a power source to enable a cell to be removed from a bank or line of operating cells.

Electrolytic cells and, specifically, membrane cells, such as filter press membrane chlor-alkali cells are susceptible to damage when disconnecting one cell from a series of cells in a circuit. This damage primarily occurs to the catalytically active coatings that are employed on the electrode surfaces of these cells. Because of the high energy employed in electrolytic cells, jumper switches must be designed to avoid arcing and to eliminate reverse current flow during a cell's shutdown and removal.

The arcing problem is a two-fold problem, the first of which has been addressed by the use of vacuum switches, such as those manufactured by Westinghouse Corporation, that employ multiple interrupting modules either in pairs or singly to mechanically synchronize the opening of resistance modules in parallel with a number of normal current carrying modules. The interrupting modules are opened last to ensure that a multiple arc drop is achieved to produce a net arc voltage greater than the maximum cell voltage to counter the property of inductance which attempts to maintain current flow at a constant level throughout the cell circuit system. This approach solves the arcing problem which can shorten the life of the jumper switch for the switch manufacturers.

The second arcing problem concerns the safety of the operator during cell disconnecting operations. This problem is addressed by this invention. There is the potential, wherever an electromotive force (EMF) is generated to balance the cell back EMF which could cause a reverse current flow electrical current to arc across the area where an operator is disconnecting the intercell connecting links between bus bars of adjacent cells while removing one cell from an operating cell line.

Numerous approaches have been taken to counter the potentially damaging results stemming from the reverse current flow problem. Auxiliary circuits have been applied to cells to supply a DC cathodic protective current of low density to a cathode during periods of inoperation of a cell. A minimal current has been supplied to a cell below the decomposition voltage level during periods of cell inactivity to protect cells using ion exchange membranes. Another alternate approach has employed the addition of a reducing agent, such as sodium sulfite or urea, to the cathode compartment when the current flow in the cell is interrupted. The reducing agent reacts with any sodium hypochlorite present in the electrolyte in the cathode compartment to prevent the deterioration of the transition metal coating on the surface of the cathode or any transition metal in the cathode itself. Still another approach has employed the use of a cell protective current between a conductor and the electrode in the cell during cell shutdowns or disconnections to prevent the passage of reverse currents through the cell.

A recent approach has employed the use of a short circuiting unit or jumper switch that has a resistor and a switch combination connected in parallel to at least one of the cells in an electrolytic cell line. A switch is closed to provide a closed loop so that current will flow through the cell in the same direction as current flows during electrolysis, but this current flow is smaller than the normal current flow during electrolysis. This system almost immediately dramatically reduces the reverse current flow after the closing of the bypass circuit switch, but there is still reverse current flow. After a finite period of time the reverse current flowing in the direction opposite to the normal current flow approaches zero.

However, all of the prior approaches have either required the use of expensive additional equipment to generate protective auxiliary current flows, the use of expensive equipment such as rectifiers, or have not completely eliminated the reverse current or back EMF flow that causes the catalytic coating on the cathode surface or the cathode itself to begin to oxidize and become, for example, a chlorine consuming instead of a chlorine generating surface. Once such damage occurs to the cathode, the cathode voltage consumption can increase from about 10 to about 20 millivolts and can shorten the economic life of a cathode after shutdown with a jumper switch.

The foregoing problems are solved in the design of the jumper switch system of the present invention.

SUMMARY OF THE INVENTION

It is an object of the present invention to provide an electrolytic cell jumper switch system which practically prevents the reverse current flow through a cell upon shutdown of at least one cell in a cell line or bank consisting of a plurality of electrolytic cells connected in series.

It is another object of the present invention to size a resistor in a cell jumper switch as a parallel resistive path across the cell that can be used to redirect the current around the cell to be disconnected without creating any reverse current flow.

It is a feature of the present invention that at least one connecting switch is employed in the cell jumper switch modules to carry the current from the immediately preceding cell to the immediately following cell, bypassing the cell to be disconnected.

It is another feature of the present invention that multiple resistors are employed in resistor module circuits which may be closed to carry the electrical current load to the resistor bank and thus to unload the current from the cell such that the IR drop balances the back electromotive force (EMF) of the unloaded cell and no current flows from the cell back through the switch and the resistor module circuits.

It is yet another feature of the present invention that the required number of resistor modules in the cell jumper switch are closed to carry substantially the entire cell current load so that only an engineered positive residual current load at most remains flowing in the cell to be disconnected and the cell current load flows through the resistor modules in the cell jumper switch around the cell to be disconnected.

It is still another feature of the present invention that the total resistance of the combined circuits used in the cell jumper switch system is calculated according to the equation $R=E_o/KA$, where $E_o$ is equal to the back EMF of the cell under zero load and KA is the maximum design load of the jumper switch.

It is yet another feature of the present invention that the cell jumper switch system first closes the switch between the cell to be disconnected and the adjacent cell to bypass the current around the intercell connector link between the immediately preceding adjacent cell and the cell to be disconnected and then reopens the switch to put the total electrical current load through the resistor modules in the switch after the connector link between the cell to be removed and the immediately preceding adjacent cell is disconnected and removed.

It is an advantage of the present invention that surges of reverse current through the cell circuit are avoided and the resultant damage to the cathodes is precluded.

It is another advantage of the present invention that the modular resistors can easily be incorporated into a cell jumper switch to simultaneously permit the bypassing of the current around and the opening of the electrical connections between adjacent cells, one of which is to be disconnected from a cell line.

It is still another advantage of the present invention that the cell line can continue to operate while removing one or more cells from service in the electrical circuit.

It is yet another advantage of the present invention that the potential for arcing is avoided in the area of a cell operator disconnecting a cell from a cell line by providing a bypass current flow path through a connecting switch around the intercell connector link being removed.

These and other objects, features and advantages are obtained in the cell jumper switch system of the present invention by providing a cell jumper switch system which loads the electrical current flow, except the engineered positive residual current load, through switch resistor modules around the cell to be disconnected, then bypasses the current flow around the intercell connector link by closing a connecting switch to permit the intercell connector link between the adjacent cells to be disconnected, and finally reopens the connecting switch to transfer the total current load in the connecting switch back to the resistor modules to avoid any reverse current, prior to closing a plurality of connecting switches, to completely bypass the electrical current around the cell to be disconnected.

BRIEF DESCRIPTION OF THE DRAWINGS

The advantages of this invention will become apparent upon consideration of the following detailed disclosure of the invention, especially when it is taken in conjunction with the accompanying drawings wherein.

DETAILED DESCRIPTION OF THE PREFERRED EMBODIMENT

Figure 1:
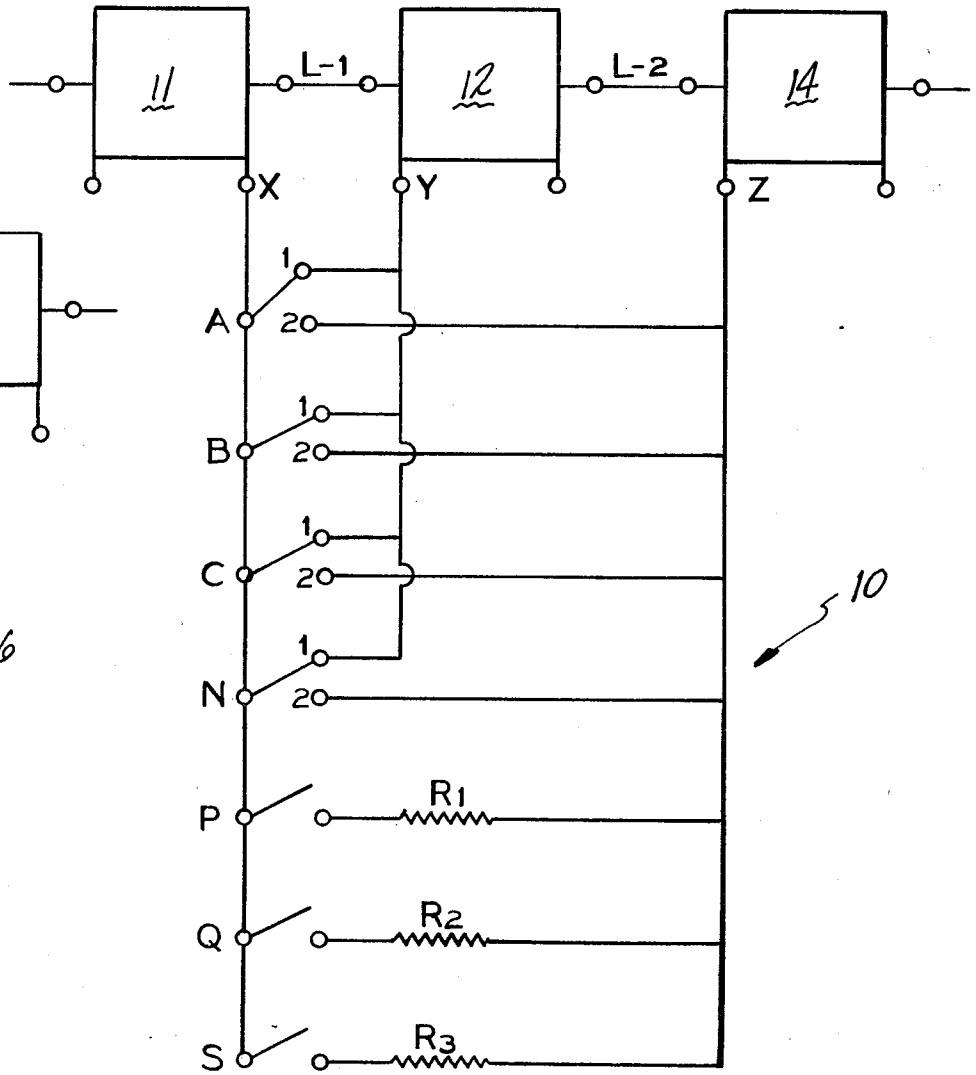
FIG. 1 is a schematic view of a portion of a bank of electrolytic cells and a modular cell jumper switch employing double throw connecting switches and single throw switches in resistor modules that are closed to permit one of a series of cells to be removed from a cell line.

FIG. 1 shows a diagrammatic illustration of a modular cell jumper switch indicated generally by the numeral 10 that is connected to a portion of a bank of adjacently positioned electrolytic cells 11, 12, and 14, respectively. The jumper switch 10 is composed of a plurality of modules, the separate electrical flow paths including the individual connecting switches A, B, C, and N and the resistors $R_1$, $R_2$ and $R_3$ each comprising a separate module. Cell 12 is to be disconnected from the bank of cells by use of the cell jumper switch 10. Cell 12 is connected to the immediately preceding cell 11 and the immediately following cell 14 by intercell connector links $L_1$ and $L_2$.

Current is directed from the immediately preceding cell 11 through the outlet bus bar X into the jumper switch 10. The current then flows through the plurality of two position connecting switches A, B, C, and N, into the inlet bus bar Y of the cell 12 to be disconnected when the two position switches are in the position 1, as well as through the inter cell connector link $L_1$. When switched to position 2, the two position switches A, B, C, and N direct current flow to the inlet bus bar Z of immediately following cell 14.

The resistor modules P, Q, and S, have switches which in the open position, as shown in FIG. 1, do not permit current to flow through the resistors, $R_1$, $R_2$, and $R_3$, respectively. In the closed position, the current passes through the resistors and bypasses cell 12, flowing into the inlet bus bar Z of the immediately following cell 14. The total resistance of the combined circuits in the cell jumper switch system is calculated according to the basic equation $R=E_o/KA$. The resistors $R_1$, $R_2$, and $R_3$ have a total parallel resistance in the combined circuits in jumper switch 10 of $R_T=(E_o+C\cdot ka)/(KA-ka)$, where $E_o$ is equal to the back EMF voltage expressed in millivolts on the cell at zero current loading, KA equals the electrical current load expressed in kiloamperes, R is defined by the formula $R=R_L+1/\Sigma(1/Rp\text{-}s)$ and is expressed in microohms, and $R_L$ is the lead resistance in series with the resistors $R_1$, $R_2$, and $R_3$ in resistor modules P, Q and S. C is a constant for each individual cell being bypassed that represents the resistive cell component in the equation $E_{cell}=E_o+C\cdot ka$ and ka is the engineered positive residual current load in the cell.

In the jumper switch 10 of the present invention a temporary engineered positive residual current load, ka, is designed to be carried by the module that includes connecting switch A to bypass current around the intercell connector link $L_1$, connecting the immediately preceding cell 11 and the cell 12 to be disconnected. When connecting switch A is closed this creates a bypass flow path around connector link $L_1$ that protects the cell operator from potential harm from a potential arcing of current across intercell connector link $L_1$ when it is removed. The total parallel resistance in the jumper switch 10 designed to have a bypass module with a connecting switch A having an engineered positive residual current load ka is expressed as $R_T=(E_o+C\cdot ka)/(KA-ka)$. This engineered positive residual current load that is to be shifted off of the cell 12 to be disconnected to the resistors by opening connector switch A in the jumper switch 10 can range from about 0% to 25% of the current load passing through the cell line, can operably range from about 3% to about 20% of the current load and preferably will range from about 5% to about 10% of the current load flowing through the cell line.

To prevent reverse current flow from passing through the cell 12 to be disconnected the total parallel resistance in the jumper switch 10 must be designed so that it is always equal to or greater than the quotient of the back EMF and the difference of the electrical current load, KA, and the positive residual current load, ka, or $R_T=(E_oC\cdot ka)/(KA-ka)$. Designing the resistor modules in jumper switch 10 so there will be no back EMF requires solving equations using the expression for the total parallel resistance and the equation $E=E_o+C(ka)$ to determine the minimum $R_T$ value necessary to keep $E_o$ at least equal to zero or positive.

This relationship can better be understood by letting the increment by which $R_T$ is to be greater than $E_o/KA$ be termed U. Then $R_T=E_o/KA+U$. Since $R_T=(E_o+C\cdot ka)/(KA-ka)$, it can be shown that $$U = \frac{(E_o + KA \cdot C) \cdot ka}{[KA(KA - ka)]}$$

This increment U becomes zero if the engineered positive residual current load ka to be shifted off of the cell 12 to the resistors in the jumper switch 10 by connecting switch A is designed to be zero.

From this procedure it can be seen that the number of resistor modules utilized in jumper switch 10 is selected to maintain a positive residual current load. The number of resistor modules selected is also a factor of the size of the resistance of the resistors employed in each module. Depending upon the current load and the size of the resistor employed, it is possible to employ a single resistor module in the jumper switch 10.

The jumper switch 10 is connected to the bank of cells in the cell line through the connections at the bus bars X, Y, and Z. Connecting switches A, B, C and N are in position one to provide an alternate path around the intercell connector link $L_1$ between cells 11 and 12. With switches A, B, C, and N in position one, the intercell connector link $L_1$ is disconnected. The resistor modules then have their individual switches closed, thereby having the total circuit load, except for the engineered positive residual current load ka, pass from bus bar X through the resistor modules with their switches and resistors $R_1$, $R_2$, and $R_3$ to bus bar Z. This creates an IR or voltage drop equal to the back EMF of the cell 12 at the engineered positive residual current load ka, thereby having the jumper switch 10 carry the positive residual load ka through switches A through N in switch position 1. The combined parallel resistance of resistors $R_1$, $R_2$ and $R_3$ is selected to be sufficiently large to result in zero reverse current flow.

The two-position connecting switches A, B, C, and N are then moved from position 1 to position 2. The switching is done rapidly so that no path for reverse current flow is provided. This also minimizes any overload on the first switch to close into position 2. The switching of all of the two-position connecting switches to position 2 completes the bypassing of the cell 12 to be disconnected and the cell 12 can be removed from the cell line by the disconnection of the intercell connector link $L_2$ and bus bar Y from jumper switch 10.

If it is desired to reinstall cell 12 or a replacement cell in the bank of cells in the cell line, the intercell connector links $L_1$ and $L_2$ are reconnected between the cell to be reconnected and the immediately preceding cell 11 and the immediately following cell 14. All of the connecting switches in the switch modules should be in the position 2. The connection to the bus bar Y of the cell 12 need not be accomplished at this point, unless functional and safety considerations make it advantageous. Following this, the two-position connecting switches should be switched from position 2 to position 1 for switches A-N. Finally, switches for the resistor modules P-S should be opened to increase the current on the cell 12 to the full load.

The modules with two-position connecting switches A-N and the switches in resistor modules P, Q, and S, comprise an electrically parallel line of switch modules to form the switching system in the cell jumper switch 10. The switch modules may be any heavy duty switching modules that are commonly used as jumper switches in chlor-alkali cells, with the exception that each switching point would consist of a double-throw or two- position switch module or its equivalent, instead of just one simple switch module. A suitable commercial embodiment may be a double-throw mechanism, such as that employed in the vacuum module based polarity reverser switch manufactured by Westinghouse Corporation.

The cell jumper switch system disclosed in FIG. 1 may be also used for a phased or stepped start-up of a cell that has been replaced on a cell line. By sequentially moving the cell connecting switches A, B, C, and N, from position 2 to position 1, the current is effectively transferred from the jumper circuit in the cell jumper switch 10 to the cell 12 which is being restarted. If the resistor modules P, Q and S with their resistor switches are closed, some of the current is bypassed around the cell 12 through the resistor elements for a brief period of time. When the switches in the resistor modules P, Q and S are sequentially opened, their current load is effectively switched to the cell 12 which is being placed back on line. When all of the load is on cell 12, all of the switch elements are open and the cell jumper switch 10 can be disconnected and removed.

Figure 2:
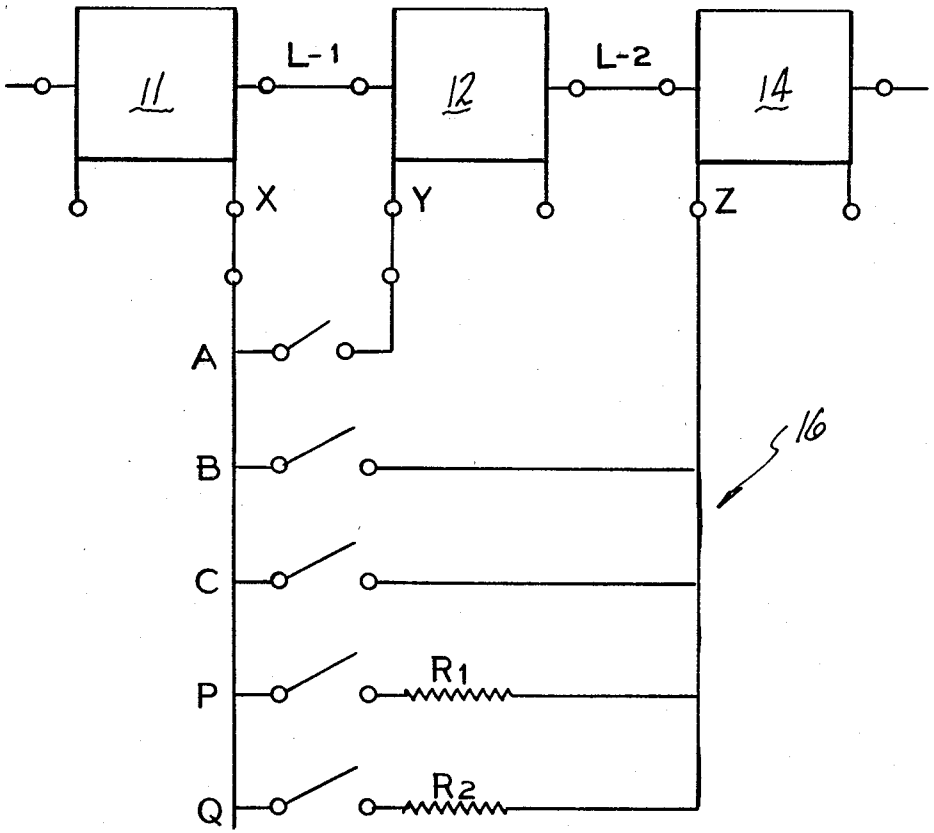
FIG. 2 is a schematic diagram showing a portion of a bank of electrolytic cells and a modular cell jumper switch employing single throw connecting switches and single throw switches in resistor modules to permit one of a series of cells to be removed from a cell line.

Another and preferred cell jumper switch system, with its switch indicated generally by the numeral 16, can be seen in FIG. 2. This cell jumper switch 16 is employed in a cell line to remove one of a series of electrolytic cells while maintaining the operation of the remainder of the cells by bypassing the electric current around the cell to be disconnected, while simultaneously avoiding the flow of back EMF through the unloaded cell.

As seen in FIG. 2, the cell jumper switch 16 is moved into position in the cell line which includes the immediately preceding cell 11, the cell 12 to be disconnected and the immediately following cell 14.

The cell jumper switch 16 is connected to the outlet bus bar X of cell 11 and the inlet bus bars Y and Z of cells 12 and 14, respectively. The cell jumper switch 16 consists of a plurality of connecting switches A, B, and C. The connecting switch A provides an alternate path for the current around the intercell connector link $L_1$ between the immediately preceding cell 11 and the cell 12 to be disconnected. Opening the connecting switch A, after the removal of link $L_1$, directs the current through the resistor modules P and Q and thereby eliminates the possibility of reverse current flow through cell 12.

Resistor modules P and Q, which have switches, permit the current to flow through the resistors $R_1$ and $R_2$, respectively, when the switches are closed, routing the electrical current from the immediately preceding cell 11 around the cell 12 to be disconnected to the immediately following cell 14. The resistance in the resistor module circuits has a combined resistance shown by the formula $R_T=(E_o+C\cdot ka)/(KA-ka)$. As explained with respect to FIG. 1 earlier, $E_o$ is equal to the voltage in millivolts of the back EMF when the cell is under the engineered positive residual current load ka and KA is equal to the total current load through the circuit. R is computed by the formula $R=R_L+1/\Sigma(1/R_{P\text{-}Q})$, where $R_L$ is equal to the lead resistance in series with the resistors $R_1$ and $R_2$ in resistor modules P and Q. The engineered positive residual current load, ka, is designed as explained with respect to FIG. 1 earlier and with the same bypass flow path utilizing connecting switch A around intercell connector link $L_1$.

The connecting switches B and C, when closed, direct the current from immediately preceding cell 11 around the cell 12 to be disconnected to the inlet bus bar Z of the immediately following cell 14. This permits the electrical current to bypass the cell 12 to be disconnected and the resistor P and Q.

Once the cell jumper switch 16 is connected to the cell line, the switches in resistor modules P and Q are then closed to permit all of the electric current, minus the engineered positive residual current load, to be unloaded from the cell 12 to be disconnected and directed through the resistor modules P and Q. The total cell electric current load KA minus the engineered positive residual current load ka then flows from the outlet bus bar X of the immediately preceding cell 11 through the resistor modules P and Q to the inlet bus bar connection Z of the immediately following cell 14. This creates an IR voltage drop equal to the back EMF of the cell 12 to be disconnected at the engineered positive residual current load ka. Therefore, the cell to be disconnected 12 carries this designed positive residual current load ka through intercell connector link $L_1$. Next, the connecting switch A is closed to bypass the electric current around intercell connector link $L_1$. This permits intercell connector link $L_1$ to be removed from between the cell 12 to be disconnected and the immediately preceding cell 11. At this point connecting switch A is reopened to put the total circuit electric current load through the resistor modules P and Q to avoid the reverse current flow that would otherwise occur when the connecting switches B and C are closed. The connecting switches B and C are then closed, removing the total cell circuit load from the resistor modules P and Q. This permits the intercell connector link $L_2$ and the inlet bus bar Y to be disconnected and the connection link $L_2$ removed. The cell 12 to be disconnected is then ready for removal from the cell line.

When it is desired to replace the cell 12 to be disconnected with a new or refurbished cell in the cell line, it may easily be reinstalled with the same cell jumper switch system 16. The connecting switches B and C and the switches in the resistor modules P and Q remain closed while the cell 12 is positioned and the intercell connector link $L_2$ is connected. The switches in resistor modules P and Q remain closed and connecting switches B and C are opened to direct the current through resistors $R_1$ and $R_2$. Connecting switch A is then closed. Since the switches in the resistor modules P and Q also remain closed, most of the current will flow directly from the immediately preceding cell 11 to the cell 12 through connector Link $L_2$ on to the immediately following cell 14. With the added safety of the bypass flow path through connecting switch A, the operator is protected from any potential arcing and intercell connector Link $L_1$ may now be connected between the cells 11 and 12.

Once this installation is complete, connecting switch A is opened. Then the resistor modules P and Q have their switches sequentially opened to sequentially shift the current to the cell 12 at the rate desired until the full circuit load is flowing to the cell 12 and all switch modules are open. At this point the connections of the cell jumper switch 16 to the outlet bus bar X and the inlet bus bar Z of cells 11 and 14, respectively, are disconnected and removed.

Alternatively, the reconnection and start-up of the refurbished cell 12 can be accomplished in the conventional way using the same jumper switch 16. Connecting switches B and C are closed and the intercell connector links $L_1$ and $L_2$ are connected. The connection from the jumper switch 16 to bus bar Y can remain disconnected. The switches in resistor modules P and Q are also closed. Connecting switches B and C are opened and then the switches in resistor modules P and Q are opened for the desired phased or stepped start-up.

While the preferred structure in which the principles of the present invention for a cell jumper switch have been incorporated as shown and described above, it is to be understood that the invention is not to be limited to the particular details and methods thus presented, but in fact, widely different means and methods may be employed in the practice of the broader aspects of this invention. It is to be understood, for example, that the cell to be bypassed could as easily be the first or the last in a cell line, instead of just an intermediate cell as discussed in the specification. It is also to be understood that the number of connecting switches utilized in the jumper switches disclosed herein is dependent upon the current load of the cell line, but can be as many as 20 or more. The scope of the claims covering the method of bypassing one of a series of electrolytic cells is intended to encompass all obvious changes in the method of operation, the details and the arrangements of parts in the cell jumper switch which will occur to one of skill in the art upon a reading of this disclosure. The application of the instant invention can equally well be made to any type of an electrolytic cell using low overvoltage cathodes where the catalytic coatings or the cathodes themselves must be protected from the detrimental effects of reverse current. The jumper switch and method of employing the jumper switch disclosed in this application may be as easily utilized in diaphragm cells employing low overvoltage cathodes as in membrane cells.

Having thus described the invention, what is claimed is:

1. A method of bypassing the electric current of at least one electrolytic cell to be disconnected in a cell bank consisting of a plurality of adjacently positioned electrolytic cells connected in series via inlet bus bar and outlet bus bar connections and intercell connector links to an electrical power source, comprising the steps of:

(a) connecting a modular cell jumper switch having switch modules and resistor modules to the inlet bar connections of the cell to be disconnected and the immediately following cell and to the outlet bus bar connection of the immediately preceding cell, the switch modules and resistor modules being connected in parallel and open;

(b) closing the resistor modules in the jumper switch to achieve a total jumper switch resistance in the combined resistor modules of $R_T=(E_o+C\cdot ka)/(KA\text{-}ka)$ so that the intercell connector link between the immediately preceding cell and the cell to be disconnected carries only an engineered positive residual current load where in the formula for the total jumper switch resistance $E_o$ is the back EMF, KA is the electrical current load, ka is the engineered positive residual current load, and C is a constant for the cell to be disconnected representing the resistive cell component in the equation $E_{cell}=E_o+C\cdot ka$;

(c) closing a connecting switch in the jumper switch between the cell to be disconnected and the immediately preceding cell; and (d) disconnecting the intercell connector link between the immediately preceding cell and the cell to be disconnected.

2. The method according to claim 1 including the steps of (a) opening the connecting switch in the jumper switch between the cell to be disconnected and the immediately preceding cell to put the total current load from the immediately preceding cell to the immediately following cell through the jumper switch resistor modules; and (b) closing a plurlity of connecting switches in the jumper switch connecting the immediately preceding cell and the immediately following cell to remove the current load from the resistor modules.

3. The method according to claim 2 including the steps of (a) disconnecting the intercell connector link between the cell to be disconnected and the immediately following cell to bypass the current around the cell to be disconnected; and (b) removing the bypassed cell to be disconnected from the cell bank.

4. The method according to claim 3 wherein the bypassed cell to be disconnected is reconnected to the cell bank by:

(a) connecting the intercell connector links between the cell to be disconnected and the cell immediately preceding and between the cell to be disconnected and the cell immediately following:

(b) opening the plurality of connecting switches in the jumper switch connecting the immediately preceding cell and the immediately following cell;

(c) opening the resistor modules in the jumper switch sequentially; and (d) disconnecting the modular cell jumper switch from the outlet bus bar of the immediately preceding cell and the inlet bus bar of the immediately following cell.

5. The method according to claim 2 wherein the connecting switch in the jumper switch between the cell to be disconnected and the immediately preceding cell is connected to the outlet bus bar connection of the immediately preceding cell and the inlet bus bar connection of the cell to be disconnected.

6. The method according to claim 5 wherein the plurality of connecting switches in the jumper switch connecting the immediately preceding cell and the immediately following cell are connected to the outlet bus bar connection of the immediately preceding cell and the inlet bus bar connection of the immediately following cell.

7. The method according to claim 2 wherein the plurality of connecting switches connecting the immediately preceding cell and the immediately following cell are two.

8. A method of bypassing the electric current of at least one electrolytic cell to be disconnected in a cell bank consisting of a plurality of adjacently positioned filter press membrane electrolytic cells connected in series via inlet bus bar and outlet bus bar connections and intercell connector links to an electrical power source, comprising the steps of:

(a) connecting a modular cell jumper switch having switch modules and resistor modules to the inlet bus bar connections of the cell to be disconnected and the immediately following cell and to the outlet bus bar connection of the immediately preceding cell the switch modules having a plurality of two position connecting switches movable between position one and position two, then switch modules and resistor modules further being connected in parallel and open;

(b) closing the resistor modules in the jumper switch to achieve a total jumper switch resistance in the combined resistor modules of $R_T=(E_o+C\cdot ka)/(KA-ka)$ so that the intercell connector link between the immediately preceding cell and the cell to be disconnected carries only an engineered positive residual current load where in the formula for the total jumper switch resistance $E_o$ is the back EMF, KA is the electrical current load, ka is the engineered positive residual current load, and C is a constant for the cell to be disconnected representing the resistive cell component in the equation $E_{cell}=E_o+C\cdot ka$;

(c) removing the intercell connector link between the immediately preceding cell and the cell to be disconnected;

(d) moving the plurality of two position connecting switches in the jumper switch from position one to position two so the engineered positive residual current load stop flowing between the cell to be disconnected and the immediately preceding cell and flows from the immediately preceding cell to the immediately following cell;

(e) removing the intercell connector link between the cell to be disconnected and the immediately following cell;

(f) removing the cell jumper switch from the inlet bus bar of the cell to be disconnected; and (g) removing the bypassed cell to be disconnected from the cell bank.

9. The method according to claim 8 wherein the two position connecting switches in the jumper switch between the cell to be disconnected and the immediately preceding cell are connected in position one to the outlet bus bar of the immediately preceding cell and the inlet bus bar of the cell to be disconnected and are connected in position two between the outlet bus bar of the immediately preceding cell and the inlet bus bar of the immediately following cell.

10. The method according to claim 9 wherein the plurality of two position connecting switches are four.

11. The method according to claim 8 wherein the cell to be bypassed is reconnected to the cell bank by:

(a) connecting the intercell connector links between the cell to be disconnected and the cell immediately preceding and between the cell to be disconnected and the cell immediately following;

(b) connecting the cell jumper switch to the inlet bus bar of the cell to be disconnected;

(c) moving the plurality of two position connecting switches in the jumper switch connecting the immediately preceding cell and the cell to be disconnected to position one;

(d) opening the resistor modules in the jumper switch sequentially; and (e) disconnecting the modular cell jumper switch from the outlet bus bar of the immediately preceding cell and the inlet bus bar of the cell to be disconnected and the immediately following cell.

12. A modular cell jumper switch for use in disconnecting one of a plurality of electrolytic cells connected in series to an electrical power source to bypass the electrical current around the cell to be disconnected prior to disconnecting the intercell connector links from between the cell to be disconnected and the immediately preceding cell and from between the cell to be disconnected and the immediately following cells comprising in combination, (a) a first connecting switch module connected to the immediately preceding cell and the cell to be disconnected to bypass the electrical current around the intercell connector link between the immediately preceding cell and the cell to be disconnected;

(b) at least a second connecting switch module connected to the immediately preceding cell and the immediately following cell to selectively bypass the electrical current around the cell to be disconnected; and (c) at least one resistor module connected in parallel to the cell to be disconnected containing a switch and a sized resistor in series to selectively bypass the electrical current from the immediately preceding cell around the cell to be disconnected to the immediately following cell.

13. The apparatus according to claim 12 wherein the first connecting switch module connected to the immediately preceding cell and the cell to be disconnected includes a two-position switch such that in position one electrical current flows to the cell to be disconnected around the intercell connector link connecting the immediately preceding cell and the cell to be disconnected and in position two electrical current flows from the immediately preceding cell to the immediately following cell.

14. The apparatus according to claim 12 wherein the at least second connecting switch module connected to the immediately preceding cell and the immediately following cell includes a two-position switch such that in position one electrical current flows to the cell to be disconnected around the intercell connector link connecting the immediately preceding cell and the cell to be disconnected and in position two electrical current flows from the immediately preceding cell to the immediately following cell.

* * * * *